United States Patent [19]

Frankel

[11] 4,393,552

[45] Jul. 19, 1983

[54] JEWELRY CLASP RETAINING MEMBER

[75] Inventor: Charles Frankel, Brooklyn, N.Y.

[73] Assignee: Laurel Enterprises, Rahway, N.J.

[21] Appl. No.: 222,531

[22] Filed: Jan. 5, 1981

[51] Int. Cl.[3] ..... A44B 11/25; A44C 5/18

[52] U.S. Cl. ..... 24/213 C; 24/214; 24/230 R

[58] Field of Search ..... 24/213 R, 213 B, 213 CS, 24/213 C, 214, 215, 230 R, 299; 63/4; 223/48; 43/44.95

[56] References Cited

U.S. PATENT DOCUMENTS

| | | | |
|---|---|---|---|
| 2,173,818 | 9/1939 | Baumer | 24/230 R X |
| 2,702,928 | 3/1955 | Nielsen | 24/214 X |
| 2,858,593 | 11/1958 | Irizarry | 24/230 R |
| 3,085,222 | 4/1963 | Watts | 24/213 R X |

*Primary Examiner*—Robert P. Swiatek

*Attorney, Agent, or Firm*—Goodman and Teitelbaum

[57] ABSTRACT

A jewelry clasp having a female housing with a male member for insertion into the housing, and a locking mechanism for releasably locking the male member into the housing. A resilient clip in the form of a substantially pear shaped configuration is mounted onto the male member to thereby effect unidirectional passage of the male member through a jewelry mounting aperture. The male member, when the clip is compressed, can pass through the aperture thereby mounting a piece of jewelry on a chain connected to the male member. When the clip is released, it returns to its expanded position and provides a thickness greater than the aperture, thereby preventing the jewelry from sliding off the chain. The clip passes through openings in the male member to secure the clip to the male member.

9 Claims, 8 Drawing Figures

JEWELRY CLASP RETAINING MEMBER

BACKGROUND OF THE INVENTION

This invention relates to jewelry clasps, and more particularly to a jewelry clasp having a retaining member which can prevent articles of jewelry from sliding off a chain connected to the clasp.

Various types of jewelry clasps are utilized to close necklaces, bracelets and the like. Typically, the jewelry clasp includes two members, each of which are respectively connected to the ends of a chain. The two members interfit within each other and can be locked together.

One such type of prior art jewelry clasp has been described in U.S. Pat. No. 4,001,923. Such clasp includes a female member and a complementary male member adapted to cooperate with a releasable locking member disposed within the body of the female member. The locking member engages the male member to hold the male member within the female member to prevent removal thereof. The female member and male member are each provided with rings or apertured portions which are respectively secured to the opposite ends of a chain on which articles of jewelry are placed.

Although such a jewelry clasp finds beneficial use, one problem existing with the jewelry clasp concerns the placement and removal of articles of jewelry from the chain. Typically, the article of jewelry has a mounting aperture which is utilized to suspend it from the chain. For example, in the case of beads, there is usually provided a hole or passageway through the bead so that the bead can be positioned on the chain. With charms and other types of jewelry, a loop is provided which passes over the chain and from which the article of jewelry depends. Typically, the male member of the jewelry clasp is threaded through such mounting aperture in order to place the jewelry article onto the chain.

One problem with the aforementioned prior art jewelry clasp concerns the ability and feasibility of adding and removing articles of jewelry from the chain. Since the male member may have an enlarged ring at its end to connect it to the chain, it is impossible to add and remove articles of jewelry from the chain without disconnecting the chain from the enlarged ring. On the other hand, if one were to reduce the size of the ring or provide an apertured male portion so that it is of approximately the same size as the mounting aperture of the jewelry, then the article of jewelry may slide off the male member and thereby get lost from the chain when the male member is separated from its locked position within the female member.

It is therefore desirable to have a type of jewelry clasp which permits easy connection of the clasp to the chain, which easily permits the addition of articles of jewelry onto the chain, and at the same time prevents the articles from accidentally falling off the chain. Nevertheless, the jewelry clasp should be provided with the ability to permit removal of the articles of jewelry from the chain when it is specifically desired to do so.

SUMMARY OF THE INVENTION

Accordingly, it is an object of the present invention to provide a jewelry clasp which avoids the aforementioned problems of prior art devices.

Another object of the present invention is to provide an improved jewelry clasp having a retaining member which prevents the jewelry from sliding off a chain connected thereto, and at the same time permits jewelry to be passed onto the chain when desired.

A further object of the present invention is to provide a jewelry clasp having a male member insertable into a housing, wherein the male member includes releasable means for permitting only unidirectional passage through a jewelry mounting aperture.

Still a further object of the present invention is to provide a jewelry clasp having a male member insertable into a housing, the male member including a resilient clip which achieves the aforementioned desired results.

Yet another object of the present invention is to provide a jewelry clasp which is easily constructed, readily utilized, and provides safety and security during utilization.

Briefly, in accordance with the present invention there is provided a jewelry clasp having a female housing, a male member for insertion into the housing, and a locking mechanism for releasably locking the male member within the housing. A resilient clip is mounted on the male member to define a retaining member for effecting unidirectional passage of the male member through a jewelry mounting aperture.

By means of the resilient clip, the article of jewelry can be passed onto the chain by compressing together the resilient clip and threading the male member through the jewelry mounting aperture. However, in its normal expanded position, the resilient clip extends laterally from the male member thereby preventing the jewelry from sliding off the male member.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 1:
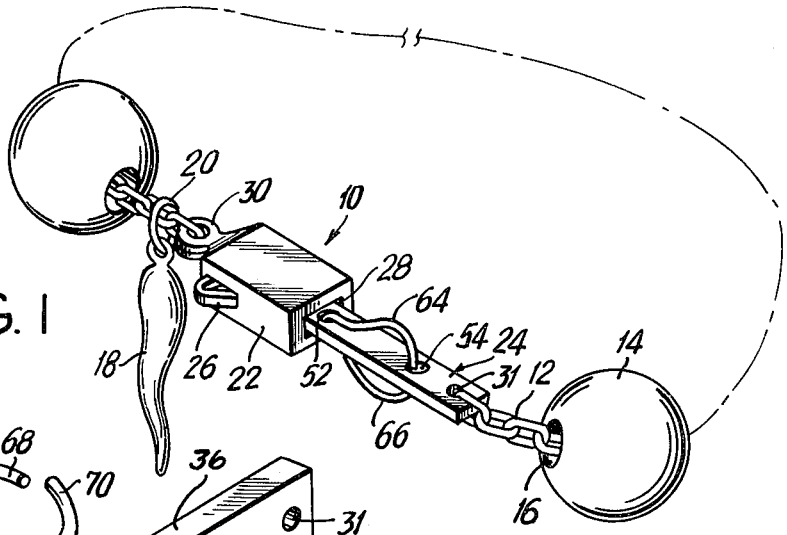
FIG. 1 is a perspective view of a jewelry clasp in accordance with the present invention, being shown connected to a chain on which there are mounted articles of jewelry.

Referring now to FIG. 1, there is shown a jewelry clasp 10, in accordance with the present invention, connected to a chain 12 on which there are mounted articles of jewelry. Two types of articles are shown. Specifically, there is shown a bead 14 which slides on the chain 12, the chain passing through the passageway 16 of the bead. There is also shown a jewelry charm 18 which is held on the chain 12 by means of the retaining loop 20 which passes along the chain. Both the passageway 16 and the retaining loop 20 serve as jewelry mounting apertures for mounting the articles of jewelry on the chain.

The jewelry clasp itself includes a female housing 22 in which is inserted a male member 24 which is held in place by means of a locking mechanism including a releasable locking catch 26. Typically, the jewelry clasp is of the type described in the aforementioned U.S. Pat. No. 4,001,923 to which reference may be made, wherein the female housing 22 includes an opening 28 which receives the male member 22. It should be understood, that other types of female housings and male members can be utilized and other locking mechanisms can also be arranged. The housing 22 includes a ring portion 30 for connection to one end of the chain 12 as is known in the art. An aperture 31 at the end of the male member 24 connects the other end of the jewelry clasp to the chain 12.

Figure 2:
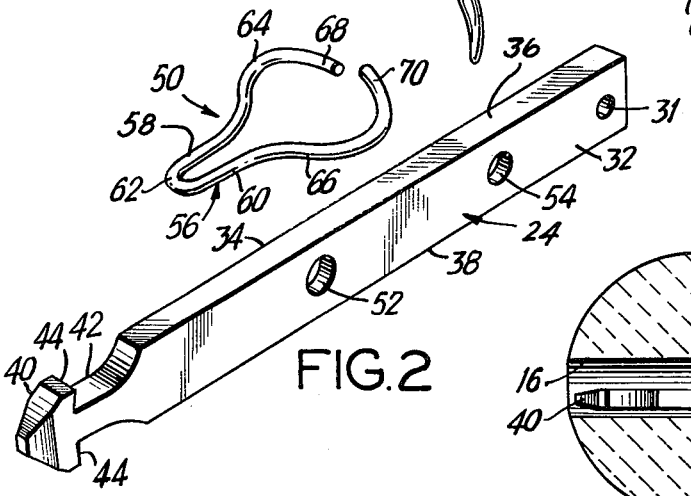
FIG. 2 is an exploded perspective view showing the male member and resilient clip in accordance with an embodiment of the present invention.

The male member 24 can best be seen in FIG. 2 as including an elongated body portion having a rectangular cross sectional configuration and including opposing flat sides 32, 34 connected by opposing edge faces 36, 38. At the front end of the male member, there is provided a chamfered or beveled nose portion 40 for facilitating entry into the housing 22. Directly behind the nose portion, there is provided a reduced neck portion 42 which is smallest in width immediately adjacent the nose portion 40 and tapers outwardly to its widest dimension spaced from the nose portion 40. A pair of cutouts 44 are formed directly behind the nose portion. The neck portion is adapted to receive the spring loaded locking member 26 in accordance with the description in the aforementioned U.S. Patent.

The size of the male member 24 is arranged so that it is smaller both in its height and width than the jewelry mounting aperture. Specifically, the male member is so sized that it can easily pass through the passageway 16 of the bead 14 and likewise pass through the retaining loop 20 of the charm 18. In this manner, the particular articles of jewelry can be placed on the chain by threading the male member through the jewelry mounting aperture provided with the article of jewelry.

The problem, however, is that when the male member is removed from the housing 22 during the time that the clasp 10 is opened, the article of jewelry can slide off the male member and thereby inadvertently become lost.

In order to retain the article of jewelry in place on the chain, while at the same time permitting the male member to be threaded through the jewelry mounting aperture, there is provided a pear shaped clip 50 which is mounted onto the male member through the longitudinally spaced apart holes 52, 54. Specifically, the clip includes a front substantially U-shaped section 56 having opposing legs 58, 60 interconnected by means of a bight section 62, the spacing between the legs 58, 60 being substantially the same as or slightly less than the thickness of the male member 24. The ends of the opposing legs 58, 60 continue into outwardly bowed sections 64, 66 which terminate in the inwardly directed arms 68, 70. The terminal ends of the arms 68, 70 form the bottom of the pear shaped clip but are not connected to each other. Instead, the arms 68, 70 are both laterally spaced apart from each other and are axially offset from each other. The clip 50 is formed of resilient material so that the two sides or sections 64, 66 of the clip can be pressed together.

Figure 3:
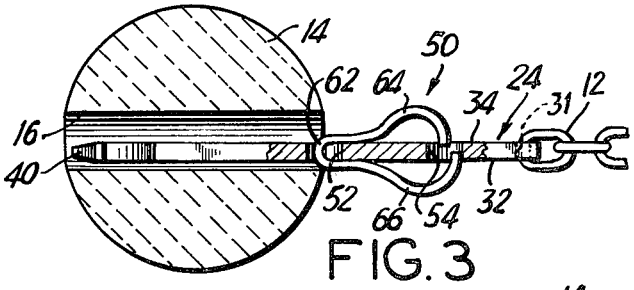
FIG. 3 is a side sectional view showing the male member being inserted through a jewelry mounting aperture.

As can best been seen in FIGS. 1 and 3, the clip 50 is mounted onto the male member 24 with the bight portion 62 passing through the aperture 52, nearest to the nose portion 40, and with the two arms 68, 70 entering into the aperture 54, nearest to the end aperture 31. The aperture 54 is of such a size that it permits the two arms 68, 70 to be compressed together and to enter into the aperture 54 with the arms adjacent to each other. The legs 58, 60 are biased against the flat sides 32, 34 of the male member to maintain the perpendicular position of the clip relative to the male member.

Figure 4:
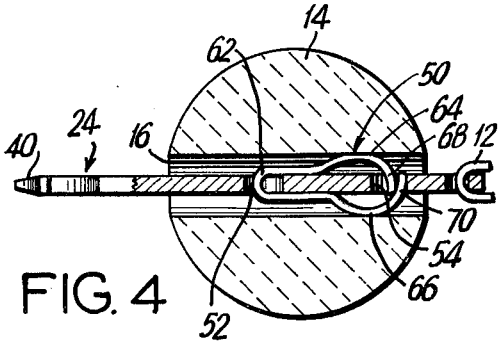
FIG. 4 is a view similar to that shown in FIG. 3, showing the continued movement of the male member through the jewelry mounting aperture.

Referring now to FIGS. 3–6, the operation of the present device will be explained. By way of example, the bead 14 is shown being placed onto the chain 12 which is connected to the male member 24 by means of the hole 31 formed at the rear of the male member. The forward end of the male member can easily enter through the passageway 16 since it is of a size smaller than the passageway opening. The lateral extension of the clip 50 on either side of the flat surfaces 32, 34 of the male member is such that in its normal unbiased position, it extends perpendicularly to a height greater than the diameter of the passageway 16. Accordingly, in order to insert the male member with the clip through the passageway 16, the two outwardly bowed sections 64, 66 of the clip must be compressed together, as shown in FIG. 4. As these two portions are being compressed, the male member 24 is pushed through the passageway 16.

It should be noted, that when the male member 24 is inserted and pushed through the passageway 16, the outwardly bowed sections 64, 66 of the clip 50 will engage the walls of the passageway 16, so that the passageway walls will serve as a cam surface to compress the sections 64, 66 of the clip together and thereby permit the male member with the clip to be further pushed through the passageway. The two arms 68, 70 will then pass adjacent to each other in the aperture 54, as can best be seen in FIG. 4. Thus, the male member 24 need only be held at the rear end portion thereof when being inserted into the bead passageway 16, wherein the sections 64, 66 of the clip 50 will automatically become compressed when engaged by the walls of the passageway.

Figure 5:
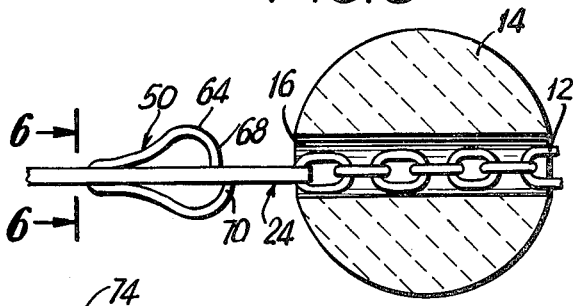
FIG. 5 is a view similar to that shown in FIGS. 3 and 4, showing the male member already passed through the jewelry mounting aperture.

Once the male member has been pushed all the way through the passageway, the arms 64, 66 of the clip will again expand, as shown in FIG. 5. The chain 12 can now be pulled through the passageway 16 so that the article of jewelry is positioned on the chain.

Figure 6:
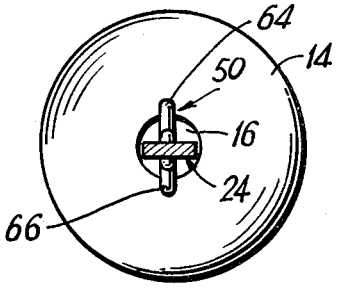
FIG. 6 is a sectional view taken along line 6—6 of FIG. 5.

It should be noted, that once the article of jewelry has passed the clip, the jewelry cannot accidentally fall off the male member. As is best shown in FIGS. 5 and 6, the article of jewelry 14 is prevented from falling off the male member 24 since the outwardly bowed sections 64, 66 of the clip 50 are together larger than the opening 16 in the head. When the bead comes in contact with the arms 68, 70, the arms will stop the bead from proceeding further along the male member, where the bead will not automatically compress the arms 68, 70. Accordingly, when it is desired to remove the bead from the chain, the sections 64, 66 of the clip must be manually compressed together, and at the same time must be pushed into the passageway 16 so that the male member 24 can be passed therethrough, similar to the showing of FIG. 4 but in the opposite direction from that described above when first inserting the male member through the bead. Once the clip is within the passageway, the male member can easily be pushed, rear end first, back through the bead.

Although there has been described placement of the bead onto the chain by threading the male member through the passageway therein, it should be understood that a similar situation would occur when passing the male member through the retaining loop 20 holding the charm 18.

Figure 7:
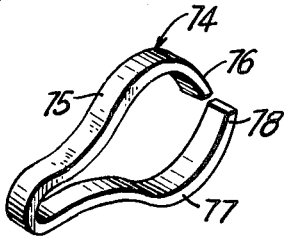
FIG. 7 is a perspective view of another embodiment of a resilient clip in accordance with the present invention.
Figure 8:
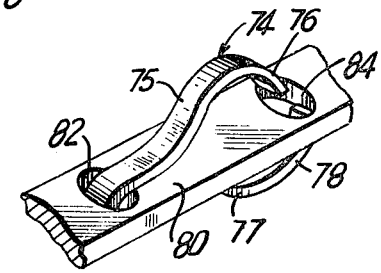
FIG. 8 is a fragmented perspective view showing the clip of FIG. 7 mounted on a male member in accordance with the present invention.

In the embodiment shown in FIGS. 2–5, the resilient clip 50 is shown made out of rod stock whereby it has a circular cross sectional configuration. As shown in FIGS. 7 and 8, the resilient clip can also be made out of other stock, such as strip stock. In FIG. 7, the clip 74 is shown formed out of such strip stock and accordingly has a rectangular cross sectional configuration. The shape is again substantially pear shaped with the two outwardly bowed sections 75, 77, and the bottom being split to define the arms 76, 78 which are laterally spaced apart and axially offset from each other.

As shown in FIG. 8, the resilient clip 74 is mounted onto a male member 80 by means of the elongated holes 82, 84 which are longitudinally spaced apart from each other. The front or U-shaped portion of the clip passes through the aperture 82 while the two arms 76, 78 enter into the aperture 84. It should be appreciated that in order to accommodate the width of the clip, it is preferable to form the apertures 82, 84 of oval shape, however, other aperture shapes such as circular, elongated, etc. can be utilized.

The various parts of the jewelry clasp, such as the male member and the housing can be fabricated from a metal material, and is usually made from a precious metal material. However, it is understood that other materials can be utilized, such as plastic and the like. The resilient clip can also be formed of metal, plastic, or other resilient material.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. In a jewelry clasp having a female housing, a male member for insertion into said housing, and locking means for releasably locking said male member within said housing, an improvement comprising:

retaining means mounted on said male member for effecting unidirectional passage of said male member through a jewelry mounting aperture associated with an article of jewelry so that the article of jewelry is retained on a chain connected to said male member;

said retaining means including a resilient clip; and said clip including outwardly bowed resilient sections laterally extending from opposing sides of said male member.

2. The jewelry clasp as in claim 1, wherein said clip is removably mounted in apertures provided in said male member.

3. A jewelry clasp as in claim 1, wherein distal free ends of said clip sections are inwardly directed toward said male member.

4. A jewelry clasp as in claim 1, wherein said clip is of substantially pear shaped configuration having an elongated axis, and including a separated bottom defining opposing free arms thereacross extending from said bowed sections, said opposing arms being laterally spaced apart and longitudinally offset from each other, and wherein said clip is colinearly positioned with respect to said male member.

5. A jewelry clasp as in claim 4, wherein said clip is fabricated from rod stock and has a substantially circular cross sectional configuration.

6. A jewelry clasp as in claim 4, wherein said clip is fabricated from strip stock and has a substantially rectangular cross sectional configuration.

7. A jewelry clasp as in claim 4, wherein said male member is an elongated body member having a front portion insertable into said housing and a rear portion which remains longitudinally extending from said housing when said male member is inserted therein, a pair of longitudinally spaced apart apertures transversely provided through said rear portion, a top of said pear shaped clip passing through a forward one of said apertures and said opposing arms extending into a rearward one of said apertures, said rearward aperture accommodating both said opposing arms when said clip is compressed together toward said body member.

8. A jewelry clasp as in claim 7, wherein said body member has a substantially rectangular cross sectional configuration, and wherein said clip extends laterally from opposing side faces of said body member, portions of said clip being engaged against said side faces to maintain said clip in a perpendicular position relative to said male member.

9. In a jewelry clasp having a female housing, a male member for insertion into said housing, and locking means for releasably locking said male member within said housing, an improvement comprising:

retaining means mounted on said male member for effecting unidirectional passage of said male member through a jewelry mounting aperture associated with an article of jewelry so that the article of jewelry is retained on a chain connected to said male member;

said retaining means including a resilient clip;

said resilient clip extending laterally on both sides of said male member; and said male member including means to receive portions of said clip therein for permitting the article of jewelry to be passed onto the chain connected to said male member.

* * * * *